US006083287A

United States Patent [19]

Germanaud et al.

[11] Patent Number: 6,083,287

[45] Date of Patent: Jul. 4, 2000

[54] DETERGENT AND ANTI-CORROSIVE ADDITIVE FOR FUELS AND FUEL COMPOSITION

[75] Inventors: Laurent Germanaud, Heyriaux; Guy Raoult, Millery; Daniele Eber, Lyons, all of France

[73] Assignee: Elf Antar France, Courbevoie, France

[21] Appl. No.: 09/147,623

[22] PCT Filed: Sep. 17, 1997

[86] PCT No.: PCT/FR97/01634

§ 371 Date: Jun. 16, 1999

§ 102(e) Date: Jun. 16, 1999

[87] PCT Pub. No.: WO98/12283

PCT Pub. Date: Mar. 26, 1998

[30] Foreign Application Priority Data

Sep. 18, 1996 [FR] France ..... 96 11388

[51] Int. Cl.[7] ..... C10L 1/22

[52] U.S. Cl. ..... 44/331; 44/348

[58] Field of Search ..... 44/331, 348

[56] References Cited

U.S. PATENT DOCUMENTS

| | | | |
|---|---|---|---|
| 3,185,704 | 5/1965 | Kahn et al. | 260/326.3 |
| 3,445,386 | 5/1969 | Otto et al. | 252/32.7 |
| 3,630,902 | 12/1971 | Coupland et al. | 252/51.5 A |
| 3,652,616 | 3/1972 | Watson et al. | 260/429 R |
| 4,501,597 | 2/1985 | Karol et al. | 44/63 |
| 4,780,111 | 10/1988 | Dorer et al. | 44/71 |
| 5,034,018 | 7/1991 | Gutierrez et al. | 44/331 |
| 5,171,421 | 12/1992 | Forester | 208/48 AA |

FOREIGN PATENT DOCUMENTS

| | | |
|---|---|---|
| 0 388 991 | 9/1990 | European Pat. Off. . |
| 1430487 | 3/1965 | France . |
| 2044305 | 2/1971 | France . |
| 1745812 | 2/1970 | Germany . |
| 684640 | 12/1952 | United Kingdom . |

*Primary Examiner*—Ellen M. McAvoy
*Attorney, Agent, or Firm*—Oblon, Spivak, McClelland, Maier & Neustadt, P.C.

[57] ABSTRACT

The invention concerns a detergent and anti-corrosive additive for engine fuels, in particular gas oil, containing amide or imide functions characterised in that it is obtained by mixing wt. 60 to 90% of a compound A consisting of at least one carboxylic polyalkenyl, diacid or anhydride, of average molecular mass between 200 and 3000, wt. 0.1 to 10% of a compound B consisting of at least one carboxylic compound, monoacid or anhydride, containing 1 to 6 carbon atoms per chain and 10 to 30% of a compound C consisting of at least one primary polyamine of general formula $H_2N—[—(CHR_1—(CH_2)_p—CHR_2)_n—NH]_m—H$, the mol ratios A/B/C corresponding to 1/(0.1 to 1)/(1 to 3), A/B/C never being 1/1/1.

13 Claims, No Drawings

DETERGENT AND ANTI-CORROSIVE ADDITIVE FOR FUELS AND FUEL COMPOSITION

The present invention relates to a bifunctional additive with detergent and corrosion-inhibiting functions which, added to engine fuels, greatly reduces problems related to the corrosion of certain parts of the engine and to the formation of deposits.

This is because the use of conventional fuels without detergent and corrosion-inhibiting additives promotes the accumulation of deposits in the induction system, in particular at the injectors, which become fouled, or even in the combustion chamber, resulting from the presence of polar aromatic compounds and of traces of lubricants.

The accumulation of deposits has a detrimental effect on the quality of evaporation of the fuel, which causes an increase in consumption, an increase in the emission of pollutants and of smoke, which is significantly greater during acceleration, and, finally, a not insignificant increase in noise.

To overcome this problem of fouling of the engine, it is possible to periodically clean the fouled components and particularly the injectors but, in the long run, this method becomes very expensive.

Another method for reducing fouling by deposits in engines and in particular on the injectors is to introduce, into the fuel, additives of detergent type with the role of being absorbed on the metal surfaces in order to prevent the formation of deposits (preventive effect) and/or to remove the deposits already formed by cleaning the injectors (curative effect). Thus, among the additives used in fuels, and even in lubricants, the products resulting from the condensation of polyalkenylsuccinic anhydrides with polyamines, such as tetraethylenepentamine, described in U.S. Pat. No. 3,172,892, are more particularly known. While these additives give good results in limiting the formation of deposits on new injectors, they nevertheless remain rather ineffective in cleaning injectors which are already fouled.

Other detergent additives, described in Patent EP 613, 938, are composed of succinic diamides substituted by polyalkylenes, preferably polyisobutenes comprising from 35 to 300 carbon atoms, the diamide resulting from the condensation of a secondary amine of N-alkylpiperazine type either with a substituted succinic acid or an anhydride or a derived monoamide or ester; these additives are preferably used in petrol-type fuels.

In addition, such compounds are known for their dispersing properties in lubricants, as is described in Patent EP 72,645.

However, while these compounds are good deter-gents, they do not completely prevent deposit formation and have a limited, or even zero, curative effect. The present invention is thus aimed at a bifunctional additive with detergent and corrosion-inhibiting properties which is compatible with the other additives conventionally introduced into fuels, in particular diesel fuels, and which makes it possible to reduce and even to prevent the formation of deposits at injectors, while limiting corrosion phenomena and while maintaining good dispersion.

The subject of the present invention is thus a bifunctional additive for engine fuels, in particular fuels of diesel type, with detergent and dispersant properties comprising amide or imide functional groups resulting from the condensation of a compound C, composed of a primary polyamine, with a compound A, composed of at least one polyalkenylcarboxylic diacid or anhydride compound, and a compound B, composed of at least one linear or branched carboxylic monoacid or anhydride compound, the said additive being characterized in that it is obtained by mixing from 60 to 90% by weight of a compound A, comprising from 2 to 20 carbon atoms per linear or branched alkylene group, having an average molecular mass varying from 200 to 3,000, from 0.1 to 10% by weight of a compound B, comprising from 1 to 6 carbon atoms per chain, and from 10 to 30% of a compound C of general formula (I) below:

$$H_2N—[—(CHR_1—(CH_2)_p—CHR_2)_n—NH]_m—H \quad (I)$$

in which $R_1$ and $R_2$, which are identical or different, represent hydrogen or a hydrocarbon group comprising from 1 to 4 carbon atoms, n is an integer varying from 1 to 3, m is an integer varying from 1 to 10 and p is an integer equal to 0 or 1.

According to the invention, the compounds A, B and C are used in A/B/C molar ratios preferably corresponding to 1/(0.1 to 1)/(1 to 3) and are necessarily other than 1/1/1. In fact, there is always an excess of polyamine in the chosen composition, which results in a certain number of $NH_2$ ends of the polyamine C being left free. The C/A molar ratio preferably varies from 1.3 to 2.0 and the B/A molar ratio preferably varies from 0.1 to 0.8.

Compared with known additives, the combination of mono- and dicarboxylic compounds, in addition to a polyamine, promotes the detergency and the corrosion-inhibiting effect of the additives according to the invention. It corresponds to a synergic effect of the combination of these three components with one another.

The average molar mass of the polyalkenylcarboxylic compounds according to the present invention preferably varies from 200 to 2,000 and most often from 200 to 1,500. These compounds are well known in the prior art; they are obtained in particular by reaction of at least one α-olefin or of at least one chlorinated hydrocarbon, both linear or branched, with maleic acid or anhydride. This olefin or this chlorinated hydrocarbon generally comprises from 10 to 150 carbon atoms, preferably 15 to 80 carbon atoms and most often from 20 to 75 carbon atoms in its molecule. The olefin can also be an oligomer, such as a dimer, a trimer or a tetramer, or alternatively a polymer of a lower olefin comprising from 2 to 10 carbon atoms, such as ethylene, propylene, n-butene, isobutene, n-hexene, n-oct-1-ene, 2-methyl-1-heptene and 2-propyl-5-propyl-1-hexene. It would not be departing from the scope of the invention if several olefins or several chlorinated hydrocarbons were mixed.

In a preferred form of the invention, the polyalkenylcarboxylic compounds are chosen from polyalkenylsuccinic acid and anhydride derivatives, the anhydride number varying from 0.5 to 1.2 milliequivalents of potassium hydroxide per gram of product.

Among succinic anhydrides, the preferred anhydrides are n-octadecenylsuccinic anhydride, dodecenylsuccinic anhydride, and polyisobutenylsuccinic anhydrides and any succinic anhydride with a weight-average molecular mass varying from 200 to 1,500.

In a preferred form of the invention, the compound B is preferably chosen from the group composed of methacrylic acid, acrylic acid, maleic anhydride, succinic anhydride, malonic acid, fumaric acid and adipic acid.

Among the primary polyamines according to the formula (I), preference is given to polyamines of the group composed of diethylenetriamine, dipropylenetriamine, triethylenetetramine, tetraethylenepentamine and their substituted derivatives.

These compounds A, B and C can be mixed without distinction in this order or in a different order. However, in a preferred method, the product C, that is to say the primary polyamine of formula (I), is added to the mixture of the products A and B, that is to say the mixture of carboxylic hydrocarbons. The operation is generally carried out by gradually introducing the polyamine C into a solution, in an organic solvent, of this mixture of carboxylic hydrocarbons at ordinary temperature and then the temperature is generally raised between 65 and 250° C. and preferably between 80 and 200° C. The organic solvent necessary for solubilization is chosen for its boiling point of between 65 and 250° C. and its ability, by azeotropic distillation of the water/solvent mixture, to remove the water formed by condensation of the polyamine with the A+B mixture. The solvent is preferably chosen from the group composed of benzene, toluene, xylenes, ethylbenzene and commercial hydrocarbon cuts, for example those distilling from 190 to 209° C. and containing 99% by weight of aromatic compounds. Of course, it would not be departing from the scope of the invention if use were made of a mixture of solvents, in particular a mixture of xylenes, or alternatively a xylene/alcohol, in particular 2-ethylhexanol, mixture, in order, on the one hand, to facilitate the homogeneity of the mixture and, on the other hand, to promote the kinetics of the reaction. After the end of the addition of the primary polyamine C, heating is maintained at reflux until the water contained has been completely removed, generally for from 0.5 to 7 hours, preferably from 1 to 5 hours.

A second subject of the invention is a fuel mainly composed of a middle distillate resulting from a crude oil direct distillation cut of between 150 and 400° C. or any other fuel with a cetane number higher than or equal to 30 and composed, to a minor extent, of the detergent and corrosion-inhibiting bifunctional additive or additives according to the first subject of the invention.

In a preferred form of this fuel, the concentration of detergent and corrosion-inhibiting additive(s) is greater than 50 ppm, preferably varying from 60 to 600 ppm.

According to the present invention, at least one additive from the group of oiliness additives, additives for improving the cetane number, deemulsifying additives and odour-modifying additives may be added to the said fuel.

The aim of the examples below is to illustrate the invention without limiting the scope thereof.

EXAMPLE I

The present example describes the preparation of several samples of detergent and corrosion-inhibiting bifunctional additives according to the invention.

These samples according to the invention are given references $X_i$ and the comparative examples $C_i$, i corresponding to a numbering which allows them to be differentiated.

The composition of these samples is given in Table I below:

TABLE I

| | A | | B | | C | | | | |
|---|---|---|---|---|---|---|---|---|---|
| Sample | Nature | a (mol) | Nature | b (mol) | Nature | c (mol) | C/A | B/A | C/B |
| $X_1$ | $A_1$ | 0.03 | MAA | 0.01 | TEPA | 0.04 | 1.33 | 0.33 | 4 |
| $X_2$ | $A_1$ | 0.03 | SA | 0.01 | TEPA | 0.04 | 1.33 | 0.33 | 4 |
| $X_3$ | $A_2$ | 0.03 | MAA | 0.01 | TEPA | 0.04 | 1.33 | 0.33 | 4 |
| $X_4$ | A | 0.03 | MAA | 0.01 | TEPA | 0.042 | 1.4 | 0.33 | 4.2 |
| $X_5$ | $A_1$ | 0.03 | MAA | 0.01 | TEPA | 0.05 | 1.6 | 0.33 | 5 |
| $X_6$ | $A_1$ | 0.03 | MAA | 0.02 | TEPA | 0.048 | 1.6 | 0.60 | 5.8 |
| $X_7$ | $A_1$ | 0.03 | MAA | 0.01 | TEPA | 0.054 | 1.8 | 0.33 | 5.4 |
| $X_8$ | $A_1$ | 0.03 | SA | 0.01 | TEPA | 0.06 | 2 | 0.33 | 6 |
| $X_9$ | $A_1$ | 0.03 | SA | 0.015 | TEPA | 0.79 | 2.4 | 0.45 | 7.9 |
| $X_{10}$ | $A_1$ | 0.03 | MAA | 0.025 | TEPA | 0.04 | 1.3 | 0.8 | 1.6 |
| $C_1$ | $A_1$ | 0.03 | | | TEPA | 0.03 | 1 | | |
| $C_2$ | | | MAA | 0.1 | TEPA | 0.1 | | 1 | |
| $C_3$ | $A_1$ | 0.03 | MAA | 0.03 | TEPA | 0.03 | 1 | 1 | 1 |

$A_1$=polyisobutenylsuccinic anhydride with an average molecular mass of 950 and an anhydride number of 0.7 milliequivalent of potassium hydroxide per gram.

$A_2$=polyisobutenylsuccinic anhydride with an average molecular mass of 950 and an anhydride number of 0.8 milliequivalent of potassium hydroxide per gram, sold under the reference ADX 104 by the company Adibis.

MAA=methacrylic acid

SA=succinic anhydride

TEPA=tetraethylenepentamine.

The samples $X_i$ combined in this Table I are obtained according to the following procedure.

The following are successively introduced into a 250 ml four-necked round-bottomed flask: a mol of polyisobutenylsuccinic anhydride A, b mol of the compound B, 25 ml of 2-ethylhexanol and 25 ml of xylene. The mixture is stirred and heated at 100° C. until a homogeneous mixture is obtained and then c mol of tetraethylenepentamine or TEPA, C, are added over approximately 5 minutes. The combined mixture is maintained at the same temperature under reflux for three to four hours until the water removed is constant in volume (1.05 ml). The products obtained exhibit two infrared absorption bands characteristic of imide functional groups at 1,700 $cm^{-1}$ and of amide functional groups at 1,670 $cm^{-1}$.

For Comparative Examples $C_1$, $C_2$ and $C_3$, the operation is as above for the samples $X_i$, but the proportions of compounds A, B and C being modified. By infrared spectroscopy, bands characteristic of absorption by imides at 1,700 $cm^{-1}$ (intense) and by amides at 1,670 $cm^{-1}$ (weak) are observed.

EXAMPLE II

The aim of the present example is to emphasize the improvement in the detergent properties of the samples according to the invention, according to the relative concentrations of A, B and C, after addition to a diesel fuel. Another aim of the present example is to emphasize the synergic effect due to the combination according to the invention.

The diesel fuel used is a diesel engine fuel, the main characteristics of which are:

density at 15° C.=0.836 kg/l initial distillation point=174° C.

final distillation point=366° C.

cetane number=53 sulphur content=0.24 weight %.

The tests were carried out on the diesel engine fuel alone or with one of the additives $X_i$ according to the invention or the comparative detergents $C_i$ added at a concentration by weight of active material of 175 ppm.

These tests consist in following the engine test procedure as described in the literature published by the SAE (Society for Automotive Engineers) under the reference SAE # 922184 in 1992. They are carried out on an assembly of two Kubota Z 600—B generators driven by 4-stroke 570 $cm^3$ two-cylinder diesel engines with indirect injection.

Each test is carried out for a period of 6 hours under the following conditions:

engine speed: 3,000 rev/min load: ⅔ of the maximum load.

At the beginning of each test, the engines are equipped with new injectors, the deliveries of which were measured prior to their installation at different needle lifts of the injectors. At the end of each test, the injectors are removed and their deliveries are measured for the same needle lifts. The effectiveness of the detergent additives tested is compared from their residual delivery percentage (rd %), calculated by the formula below.

$$\text{Residual delivery \%} = \frac{\text{Average delivery of the injectors, end of test}}{\text{Average delivery of the new injectors}} \times 100$$

The results obtained are combined in Table II below.

TABLE II

| Needle lift (mm) | 0.05 | 0.10 | 0.20 | 0.30 | 0.40 | 0.50 |
|---|---|---|---|---|---|---|
| Diesel fuel alone | 10 | 14 | 23 | 31 | 40 | 54 |
| Diesel fuel + $X_1$ | 48 | 53 | 62 | 73 | 83 | 88 |
| Diesel fuel + $X_2$ | 50 | 59 | 78 | 87 | 92 | 93 |
| Diesel fuel + $X_3$ | 77 | 80 | 89 | 92 | 93 | 93 |
| Diesel fuel + $X_4$ | 54 | 60 | 70 | 80 | 86 | 91 |
| Diesel fuel + $X_5$ | 64 | 74 | 82 | 89 | 93 | 95 |
| Diesel fuel + $X_6$ | 67 | 78 | 83 | 88 | 91 | 92 |
| Diesel fuel + $X_7$ | 79 | 85 | 92 | 94 | 95 | 95 |
| Diesel fuel + $X_8$ | 68 | 78 | 91 | 95 | 95 | 95 |
| Diesel fuel + $X_9$ | 30 | 34 | 45 | 56 | 65 | 69 |
| Diesel fuel + $X_{10}$ | 35 | 39 | 49 | 57 | 68 | 72 |
| Diesel fuel + $C_1$ | 34 | 38 | 48 | 58 | 67 | 73 |
| Diesel fuel + $C_2$ | 0 | 0 | 0 | 0 | 0 | 0 |
| Diesel fuel + $C_3$ | 18 | 22 | 33 | 42 | 54 | 65 |

As is shown in Table I, the additives according to the invention give residual deliveries which are much greater than those of diesel fuel alone and diesel fuel to which the comparative detergent additives have been added.

EXAMPLE III

The aim of the present example is to demonstrate the effectiveness of the additives according to the invention in cleaning injectors which are already fouled (curative effect), compared with the additives C, according to the procedure described in Example II. Prior to each test, the injectors are prefouled with an additive-free diesel fuel for 6 hours according to the procedure described in Example II.

The residual deliveries after the stage of fouling with the diesel fuel alone are those shown in line 1 in Table II.

The effectiveness of the additives in cleaning the already fouled injectors is calculated from the following formula:

$$\text{\% effectiveness} = \frac{\text{Average delivery of the injectors, end of test}}{\text{Average delivery of the fouled injectors (beginning of test)}} \times 100$$

TABLE III

| Needle lift (mm) | 0.10 | 0.20 | 0.30 | 0.40 | 0.50 |
|---|---|---|---|---|---|
| Diesel fuel + $X_1$ | 230 | 190 | 174 | 158 | 120 |
| Diesel fuel + $X_2$ | 243 | 210 | 180 | 170 | 135 |
| Diesel fuel + $X_3$ | 260 | 217 | 198 | 172 | 135 |
| Diesel fuel + $C_1$ | 164 | 139 | 132 | 135 | 115 |
| Diesel fuel + $C_3$ | 207 | 165 | 158 | 145 | 120 |

The effectiveness results for the additives with respect to cleaning the fouled injectors, combined in Table III, are given for each needle lift; they further show the superiority of the additives according to the invention.

The aim of the present example is to show the superiority of the additives according to the present invention in relation to the comparative additives C.

The corrosion tests consist in determining the corrosion-inhibiting effect of the additives in the diesel fuel on polished ordinary steel samples in the presence of synthetic seawater, according to ASTM Standard D665, at a temperature of 60° C. for a period of 24 hours. They are expressed as % of surface corroded.

TABLE IV

| Fuel | % of surface corroded |
|---|---|
| Diesel fuel alone | 100 |
| Diesel fuel + $X_1$ | 10 |
| Diesel fuel + $X_2$ | 10 |
| Diesel fuel + $X_3$ | 5 |
| Diesel fuel + $X_4$ | 5 |
| Diesel fuel + $C_1$ | 25 |
| Diesel fuel + $C_2$ | 60 |
| Diesel fuel + $C_3$ | 20 |

As is shown by the results in Table IV, the additives according to the invention have excellent corrosion-inhibiting properties which are superior to those of the known products.

What is claimed is:

1. A detergent and corrosion-inhibiting additive for engine fuels, comprising compounds having amide or imide functions resulting from the condensation of a compound C comprising a primary polyamine with a compound A comprising at least one polyalkenyl carboxylic, diacid or anhydride compound and a compound B comprising at least one straight-chain or branched carboxylic, monoacid or anhydride compound, wherein said additive is obtained by mixing from 60 to 90 wt % of compound A, containing from 2 to 20 carbon atoms per straight-chain or branched alkenyl group and having an average molecular weight ranging from 200 to 3000, from 0.1 to 10 wt % of compound B, and from 10 to 30 wt % of compound C represented by formula (I):

$$H_2N—[—(CHR_1—(CH_2)_p—CHR_2)_p—NH]_m—H$$

wherein $R_1$ and $R_2$, identical or different, are hydrogen or a hydrocarbon group containing from 1 to 4 carbon atoms, n is an integral number ranging from 1 to 3, m is an integral number ranging from 1 to 10 and p is an integral number equal to 0 or 1, wherein the molar ratio A/B/C is 1/(0.1 to 1)/(1 to 3), wherein A/B/C is not 1/1/1, wherein the molar ratio C/A is from 1.3 to 2.0, and the molar ratio B/A is from 0.1 to 0.8.

2. An additive according to claim 1, wherein compound B is selected from the group consisting of a methacrylic acid, acrylic acid, maleic anhydride and succinic anhydride.

3. An additive according to claim 1, wherein the average molecular weight of polyalkenyl carboxylic compounds A ranges from 200 to 2000.

4. The additive of claim 3, wherein the average molecular weight of polyalkenyl carboxylic compounds A ranges from 200 to 1500.

5. An additive according to claim 1, wherein the polyalkenyl carboxylic compounds are selected from the group consisting of polyalkenyl succinic acid and anhydride derivatives with anhydride index ranging from 0.5 to 1.2 milliequivalents of potash per gram of compound.

6. An additive according to claim 2, wherein the succinic anhydride is selected from group consisting of n-octadecenylsuccinic anhydride, dodecenylsuccinic anhydride, polyisobutenylsuccinic anhydrides, and succinic anhydrides having a weight-average molecular weight ranging from 200 to 1500.

7. An additive according to claim 1, wherein compound B is selected from the group consisting of methacrylic acid, acrylic acid, maleic anhydride, succinic anhydride, malonic acid, fumaric acid and adipic acid.

8. An additive according to claim 1, wherein the primary polyamines are selected from group consisting of diethylenetriamine, dipropylenetriamine, triethylenetetramine, tetraethylenepentamine, and substituted derivatives thereof.

9. An additive according to claim 1, obtained by a process comprising:

i) introducing the products A and B into an organic solvent with boiling point of between 65 and 250° C., ii) progressively introducing product C, iii) then raising the temperature of the mixture to a temperature of between 65 and 250° C., and iv) then distilling the water/solvent heteroazeotrope(s) while maintaining the mixture under reflux at the distillation temperature of the heteroazeotrope(s) until complete elimination of the water formed by the reaction of condensation of the polyamine with the acids.

10. The additive of claim 9, wherein the temperature in iii) is between 80 and 200° C.

11. The additive of claim 9, wherein iv) comprises distilling the water/solvent heteroazeotrope(s) while maintaining the mixture under reflux at the distillation temperature of the heteroazeotrope(s) until complete elimination of the water formed by the reaction of condensation of the polyamine with the acids, for 1 to 5 hours.

12. A fuel comprising a major portion of at least one middle distillate obtained from a cut of direct distillation of crude oil between 150 and 400° C. or any other fuel of cetane number higher than or equal to 30, and a minor portion of at least one additive according to claim 1.

13. A fuel according to claim 12, which contains at least 50 ppm and preferably from 60 to 600 ppm of the detergent and corrosion-inhibiting additive or additives.

* * * * *